United States Patent [19]

Wagner

[11] 4,156,471

[45] May 29, 1979

[54] RUBBLE AND CORE REMOVAL APPARATUS

[76] Inventor: Gary L. Wagner, P. O. Box 902, Burlington, Iowa 52601

[21] Appl. No.: 832,103

[22] Filed: Sep. 9, 1977

[51] Int. Cl.[2] ..... E21B 9/20; E21B 37/00

[52] U.S. Cl. ..... 175/394; 175/310; 175/323; 175/396; 294/86.1

[58] Field of Search ..... 175/310, 323, 394, 396, 175/84; 299/87; 198/658, 661, 676; 294/86.1

[56] References Cited

U.S. PATENT DOCUMENTS

| | | | |
|---|---|---|---|
| 181,578 | 8/1876 | Howe | 175/394 X |
| 903,194 | 11/1908 | Johanson | 175/396 X |
| 1,457,583 | 6/1923 | Loofs et al. | 175/396 |
| 2,665,796 | 1/1954 | Anderson | 198/658 |
| 3,388,949 | 6/1968 | Kozar | 175/394 X |

*Primary Examiner*—Ernest R. Purser
*Assistant Examiner*—Nick A. Nichols, Jr.
*Attorney, Agent, or Firm*—Mason, Fenwick & Lawrence

[57] ABSTRACT

A rubble and core removal apparatus including a casing, open at one end, with spirally extending flighting disposed therein, the flighting being secured to the inner wall of the casing and extending radially inwardly thereof in changing dimension, the casing having a connection to permit rotation and lifting of the apparatus.

3 Claims, 3 Drawing Figures

RUBBLE AND CORE REMOVAL APPARATUS

BACKGROUND OF THE INVENTION

Removal of the debris from the core of a drilled well hole may be accomplished in many ways. One conventional method is to capture the debris on an auger and lift the debris out with the auger. Other debris removal techniques involve the use of a clam shell shovel or, sometimes, injection of concrete into the opening to stabilize the rubble for later removal as a core.

The present invention is directed to the provision of removal apparatus for the removal of debris and rock cores from well holes of large diameter such as 12 inches and larger.

The rubble and core removal apparatus set forth herein involves the use of a large diameter casing with spirally extending flighting secured to the inner wall thereof. The inner free diameter of the flighting decreases as the flighting extends upwardly from the open end of the casing thereby creating wedging to trap debris therein.

It is a primary object of the present invention to provide a new and improved core and rubble removal apparatus.

Another object of the present invention is to provide an improved core removal apparatus for large diameter well holes wherein rubble, gravel, boulders, rock, and the like, are wedged in the casing for removal from the well hole and for disposal.

Other objects involve the provision of a core removal apparatus that is economical to manufacture, easy to use, durable in use and which is readily and economically maintained.

Other objects and advantages of the invention will become more apparent to those persons having ordinary skill in the art to which the present invention pertains from the following description taken in conjunction with the accompanying drawings wherein.

Figure 1:
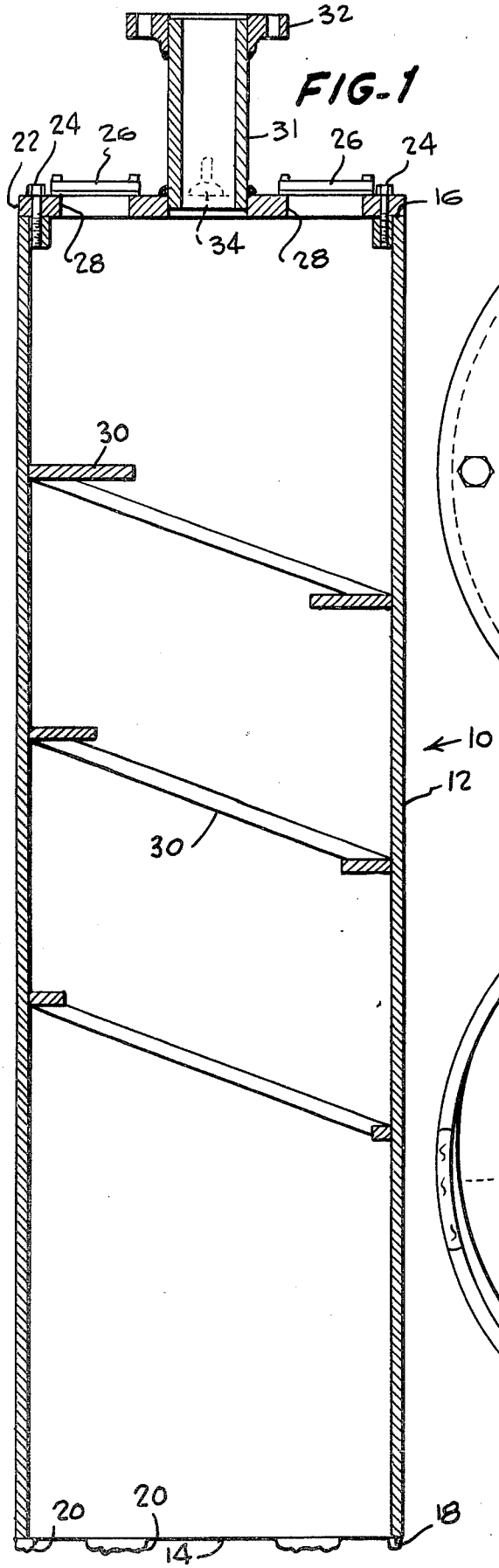
FIG. 1 is a sectional side elevational view of a preferred embodiment of the present invention showing the casing with flighting disposed therein.

Referring more particularly now to the drawings, the core removal apparatus is identified by reference numeral 10 and is defined by the cylindrical casing 12 being open at one end 14 and closed at the other end 16 thereof. A bottom wall 18 of the open end 14 of the casing 12 is provided with carbide chip teeth 20 which are adapted to cut into the earth, or the like, to assist in clearing a path for the casing and associated apparatus to move into the well hole being defined by the apparatus.

The upper end 16 of the casing 12 is closed by the removable top 22 with the top being secured to the casing by removable bolts 24 anchored to support means securely fastened to the casing 12.

Inspection port covers 26 are removably secured to the top 22 to cover openings 28 defined within the top 22. It can readily be seen that openings 28 provide means for the user to inspect the interior of the casing 12 as necessary in use of the apparatus.

A spirally extending flight 30 is rigidly secured to the inner wall of the casing 12, as represented in FIG. 1, with the smallest radially extending dimension of the flight being located nearest the open bottom 14 of the rubble and core apparatus and the largest radially extending dimension of the flight being located nearest the top 16 of the casing 12.

Figure 3:
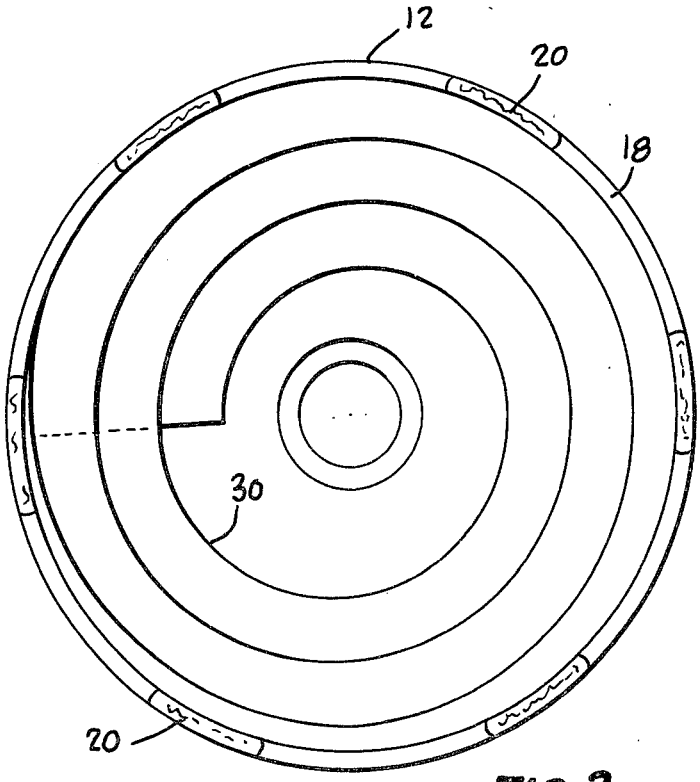
FIG. 3 is a bottom view of the embodiment shown in FIG. 1.

The radial dimension of the flight increases gradually from the end of the flighting which starts at a location above the bottom 14 to the top 16 of the casing as the flight extends upwardly and spirally along the inside wall of the casing 12 to define a gradually decreasing opening extending upwardly as shown in FIGS. 1 and 3. This decreasing opening defines means for wedging and lifting of material by portions of the flighting in the casing for removal thereof from the well hole being drilled.

The top of the casing 12 is further provided with a drill stem unit 31 terminating in a coupling flange 32 at the top thereof. The coupling flange is adapted to be secured to a suitable power source associated with the apparatus to provide means for rotating the apparatus in use thereof.

Figure 2:
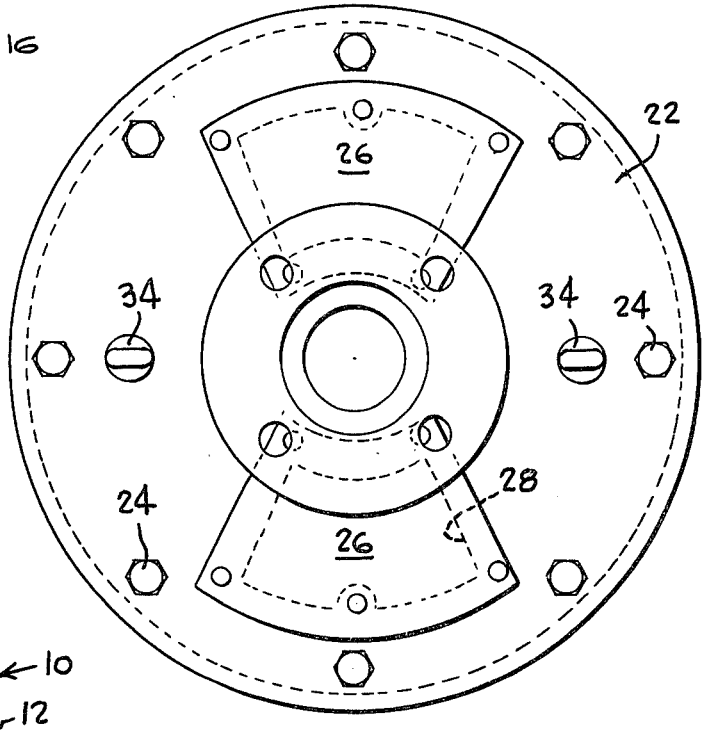
FIG. 2 is a top view of the embodiment shown in FIG. 1.

Lift eyes 34 disposed on the top cover 22 on both sides of the drill stem as suggested in FIGS. 1 and 2 provide a means for handling the apparatus.

While I have shown and described a specific embodiment of the present invention it will, of course, be understood that other modifications and alternative constructions may be used without departing from the true spirit and scope of the invention such as multiple flighting in the casing. I therefore intend by the appended claims to cover all such modifications and alternative constructions as fall within their true spirit and scope.

I claim:

1. An apparatus for removing debris from a well hole comprising a case defined by a cylindrical tube opening at one end with the lower edge of said tube forming said open end, said lower edge of said tube terminating in a plane generally perpendicular to the axis of said cylindrical tube, and a spirally extending flighting within said casing having one side of said flighting rigidly secured to the inner wall of said casing and the other side of said flighting extending radially inwardly of the casing and terminating in spaced relationship to the inner wall of the casing, said flighting having an increasing radial dimension as the distance from the open end increases thereby defining an opening therethrough of decreasing diameter for wedging the debris to be removed and said flighting being spaced from said lower edge to permit wedging between said flighting and said tube of rocks as large as the inside diameter of the cylindrical tube thereby permitting removal of rocks as large as the well hole.

2. The apparatus of claim 1 additionally including a removable closure for the end opposite the open end to permit inspection of the interior of the casing.

3. The apparatus of claim 2 additionally including a cutting means mounted on the lower edge of said casing to assist in clearing a path for the apparatus.

* * * * *